US006913111B2

(12) United States Patent
Schorn et al.

(10) Patent No.: US 6,913,111 B2
(45) Date of Patent: Jul. 5, 2005

(54) MOUNTABLE DISCHARGE PIPE FOR AN END MUFFLER AS WELL AS AN END MUFFLER FOR MOTOR VEHICLE

(75) Inventors: Juergen Schorn, Rutesheim (DE); Michael Wessels, Weissach (DE); Manfred Hein, Leonberg (DE)

(73) Assignee: Dr. Ing. h.c.F. Porsche AG, Stuttgart (DE)

( * ) Notice: Subject to any disclaimer, the term of this patent is extended or adjusted under 35 U.S.C. 154(b) by 0 days.

(21) Appl. No.: 10/143,854

(22) Filed: May 14, 2002

(65) Prior Publication Data

US 2002/0185332 A1 Dec. 12, 2002

(30) Foreign Application Priority Data

May 15, 2001 (DE) ..... 101 23 567

(51) Int. Cl.[7] ..... F01N 7/18
(52) U.S. Cl. ..... 181/243; 181/227; 181/228
(58) Field of Search ..... 181/243, 282, 181/227, 228; F01N 7/08, 7/18, 7/10

(56) References Cited

U.S. PATENT DOCUMENTS

| | | | | |
|---|---|---|---|---|
| 1,995,840 A | | 3/1935 | Compo | |
| 5,073,353 A | | 12/1991 | Florian | |
| 5,164,551 A | * | 11/1992 | Harwood et al. | 181/238 |
| 5,740,846 A | * | 4/1998 | Larson et al. | 141/382 |
| 5,817,991 A | * | 10/1998 | Suyama et al. | 181/243 |
| 6,070,695 A | * | 6/2000 | Ohtaka et al. | 181/282 |
| 2002/0036114 A1 | * | 3/2002 | Tobias | 181/241 |

FOREIGN PATENT DOCUMENTS

| | | | | |
|---|---|---|---|---|
| DE | 4205454 A1 | | 8/1993 | |
| DE | 19726059 | | 1/1998 | |
| DE | 19653908 | | 6/1998 | |
| DE | 29904934 U1 | | 8/2000 | |
| DE | 19914426 A1 | | 10/2000 | |
| EP | 0969188 | | 1/2000 | |
| JP | 04072417 A | * | 3/1992 | F01N/7/08 |
| JP | 08319825 A | * | 12/1996 | F01N/7/08 |

* cited by examiner

*Primary Examiner*—Marlon T. Fletcher
*Assistant Examiner*—David S. Warren
(74) *Attorney, Agent, or Firm*—Crowell & Moring LLP

(57) ABSTRACT

A mountable discharge pipe for an end muffler has devices for fastening the discharge pipe to an end muffler housing. A hook provided on the discharge pipe can be suspended at the end muffler housing, and a holding lug provided with an opening is arranged at the discharge pipe. The holding lug can be fastened by way of a nut-bolt connection on the end muffler housing. As a result, an easily mountable fastening of a discharge pipe on an end muffler is achieved.

2 Claims, 5 Drawing Sheets

MOUNTABLE DISCHARGE PIPE FOR AN END MUFFLER AS WELL AS AN END MUFFLER FOR MOTOR VEHICLE

This application claims the priority of German application 101 23 567.4, filed May 15, 2001, the disclosure of which is expressly incorporated by reference herein.

BACKGROUND AND SUMMARY OF THE INVENTION

The present invention relates to a mountable discharge pipe for an end muffler of a motor vehicle, as well as to the end muffler for the motor vehicle itself.

An air-gap-insulated end pipe for an exhaust pipe of an exhaust system is known from German Patent Document DE 199 14 426 A1. The end pipe is pushed, with a plug-type fit, onto the exhaust pipe, and secured by way of a screwed connection. In order to avoid tarnishing of the double-walled end pipe as a result of thermal linking to the exhaust pipe, additional measures, for example air inlet openings for increasing a cooling effect in the end pipe, are provided.

It is one object of the invention to improve linking of a mountable discharge pipe for an end muffler of a motor vehicle such that a simple and rapidly releasable linkage of an end pipe to the end muffler is ensured and fastening takes place so as to largely avoid heat conduction from the end muffler housing to the end pipe, thereby preventing tarnishing of the end pipe which would be visible toward the outside.

An end muffler housing, furthermore, is to be provided with fastening devices by which the mountable discharge pipe according to the invention can be fastened on the end muffler housing.

The object of the invention referred to above, and others, may be achieved by a mountable discharge pipe for an end muffler of a motor vehicle having devices for fastening the discharge pipe to an end muffler housing including a hook provided on the discharge pipe. The hook can be suspended at the end muffler housing. A holding lug provided with an opening is arranged at the discharge pipe, and the holding lug can be fastened by way of a nut-bolt connection on the end muffler housing. According to another aspect of the invention, an end muffler for a motor vehicle includes a housing, which has at least one inlet-side opening and at least one outlet-side opening, and a mountable discharge pipe such as that mentioned above at the outlet-side opening. The housing has two half shells which are connected with one another by way of beaded edges, and, on a side of the housing facing the discharge pipe, a lug, which has an opening, is provided. The lug is connected by way of the nut-bolt connection with the holding lug arranged at the discharge pipe.

A discharge pipe, provided with a hook, can be hooked, in a simple manner at a suitable point, into the end muffler housing, and can be secured by a lug provided on the underside of the discharge pipe by way of a nut-bolt connection at the end muffler housing. As a result of this fastening method, the discharge pipe itself is not directly connected with the end muffler housing, so that heat conduction from the end muffler housing to the discharge pipe is largely prevented.

Additional advantageous further features of the mountable discharge pipe according to the invention are reflected in certain claims. A discharge pipe mounting process is also claimed.

The hook provided for fastening the discharge pipe and the lug provided with an opening are advantageously made of a one-piece sheet metal strip which is fastened between two individual pipes of the discharge pipe. Such a strip may, for example, be welded to single spots.

When the discharge pipe is mounted to an end muffler housing, it is particularly advantageous for a nut corresponding to the opening in the lug to be welded or soldered onto the lug.

The housing of an end muffler provided for fastening the discharge pipe has two half shells forming a beaded edge on which the hook provided on the discharge pipe can advantageously be hooked in. The end muffler housing also has a lug provided with an opening. This lug is connected by way of a nut-bolt connection with the lug provided on the discharge pipe.

The housing of the end muffler is provided with two discharge openings, each of which is surrounded by a collar. For exhaust-gas-side linkage of the discharge openings to the end pipe provided with two individual pipes, exhaust pipes of the end muffler fastened in the collar engage in the two individual pipes. The diameter of the exhaust gas pipes fastened in the collar is smaller than the diameter of the individual pipes, so that a direct thermal linkage of the end muffler housing to the discharge pipe is prevented.

The invention will be explained in detail with reference to an embodiment illustrated in the figures.

BRIEF DESCRIPTON OF THE DRAWINGS

DETAILED DESCRIPTION OF THE INVENTION

An end muffler housing 2 has two half shells 2A and 2B, which are mutually connected at their circumferential edges such that a beaded collar edge 4 is constructed. The muffler housing 2 is constructed for a two-flow exhaust system, for which two inlet openings 6 (only one side being shown in FIG. 5) are provided on both sides of the end muffler housing 2. Correspondingly, two exhaust pipes, which are not shown, are flanged to the openings 6. A suspension 8 permits the mounting of the muffler housing 2 on the chassis of a motor vehicle.

Figure 1:
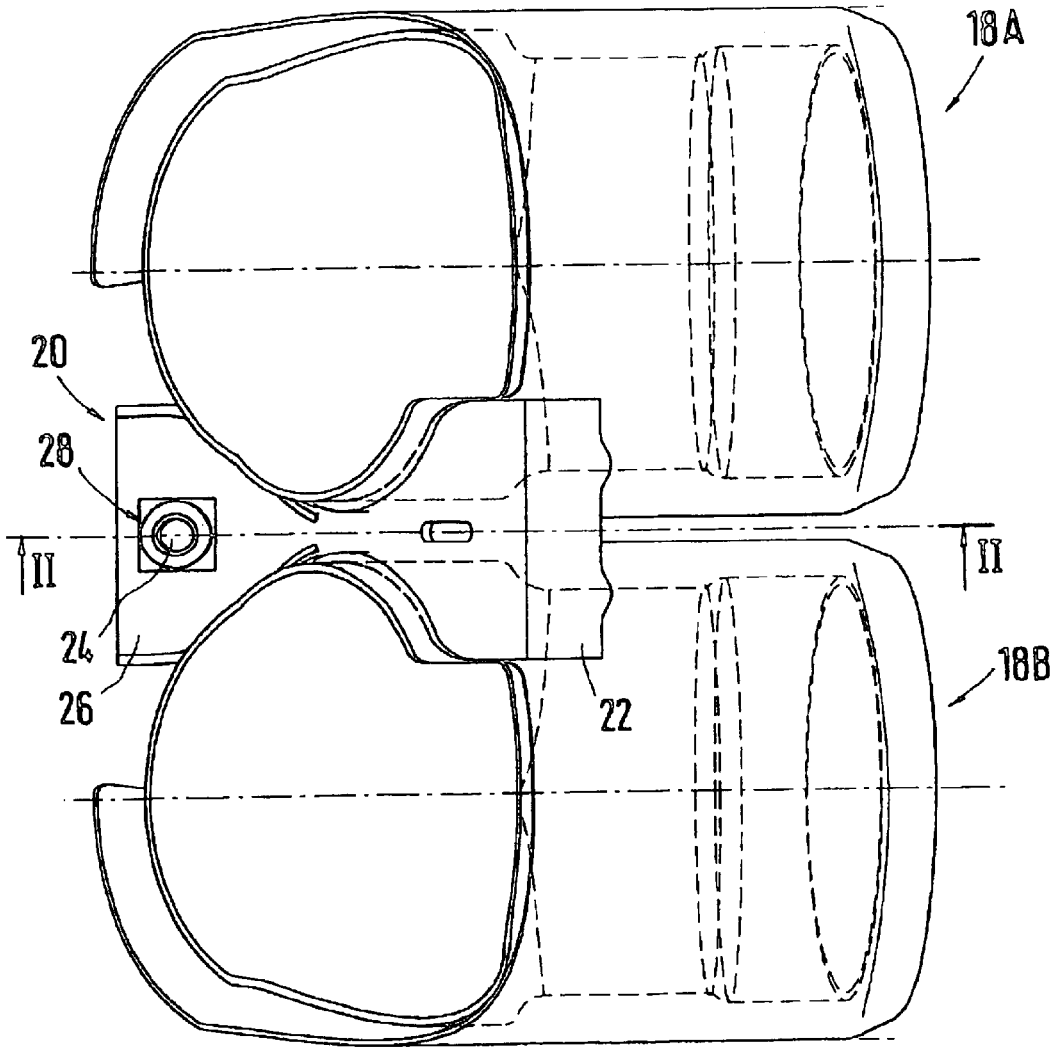
FIG. 1 is a top view of a mountable discharge pipe of an end muffler.
Figure 2:
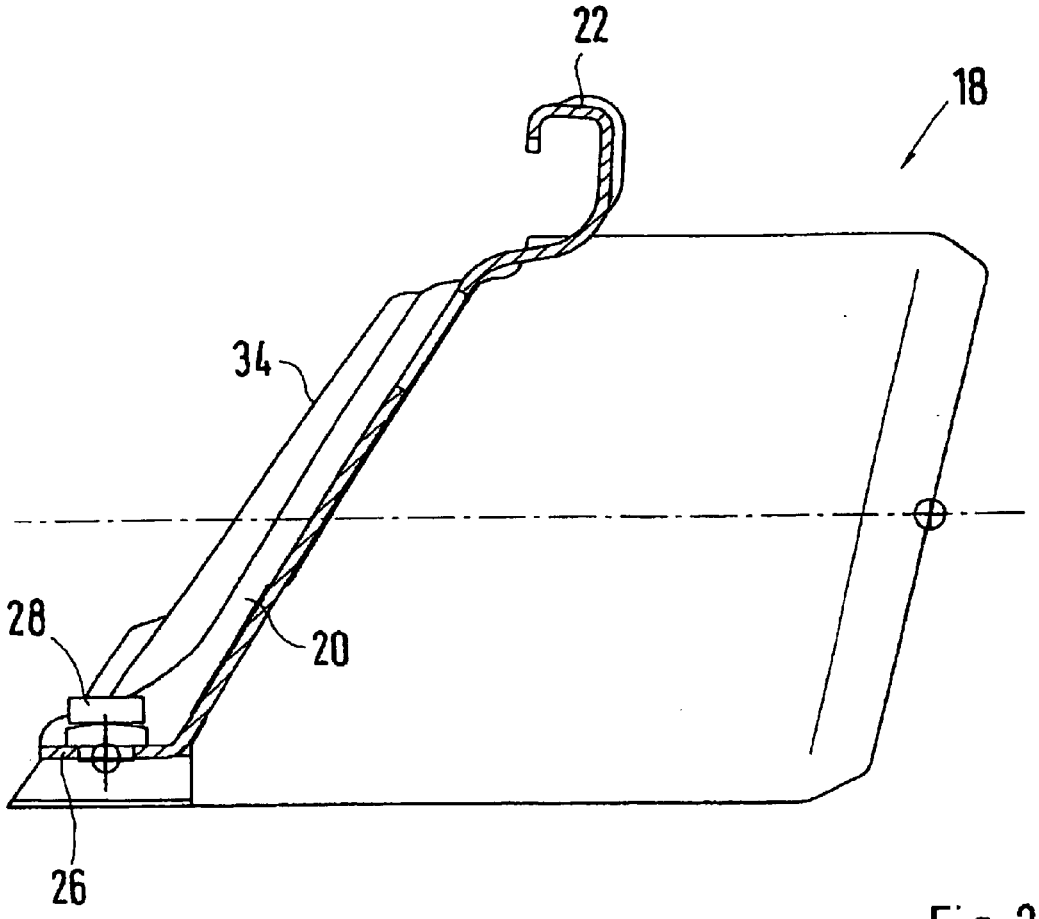
FIG. 2 is a sectional view along line II—II in FIG. 1.
Figure 3:
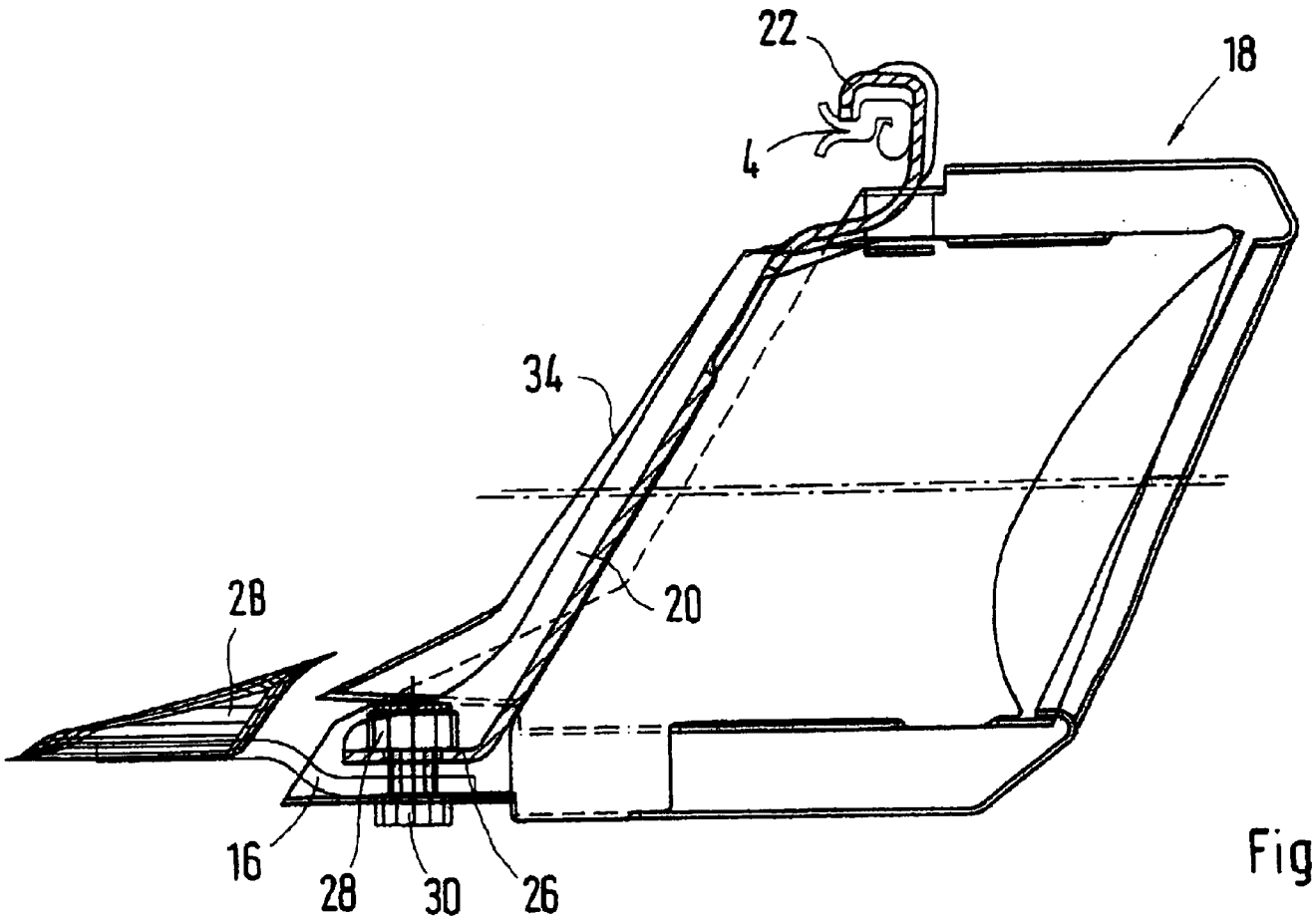
FIG. 3 is a sectional lateral view of the discharge pipe.
Figure 4:
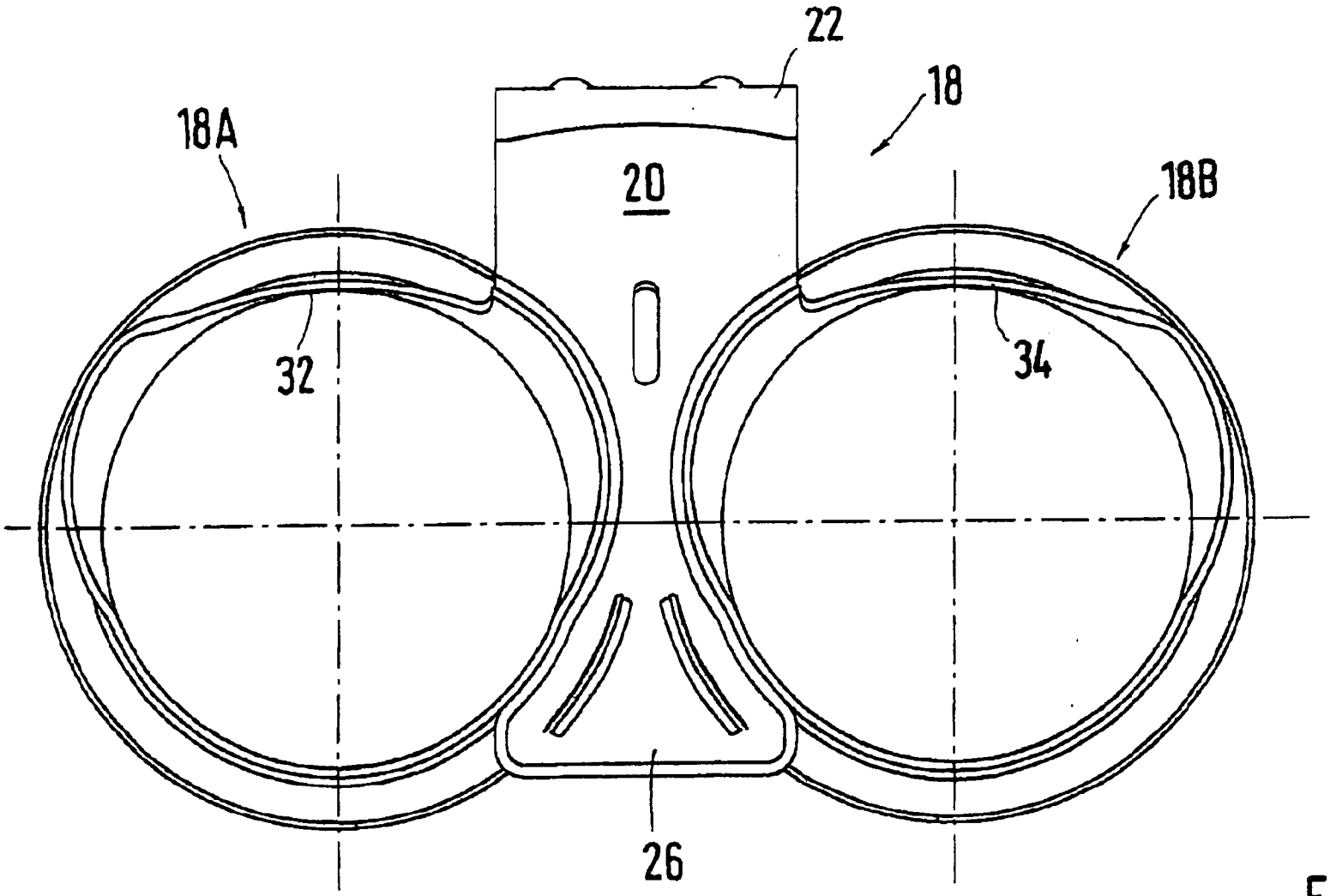
FIG. 4 is a rear view of the discharge pipe.
Figure 5:
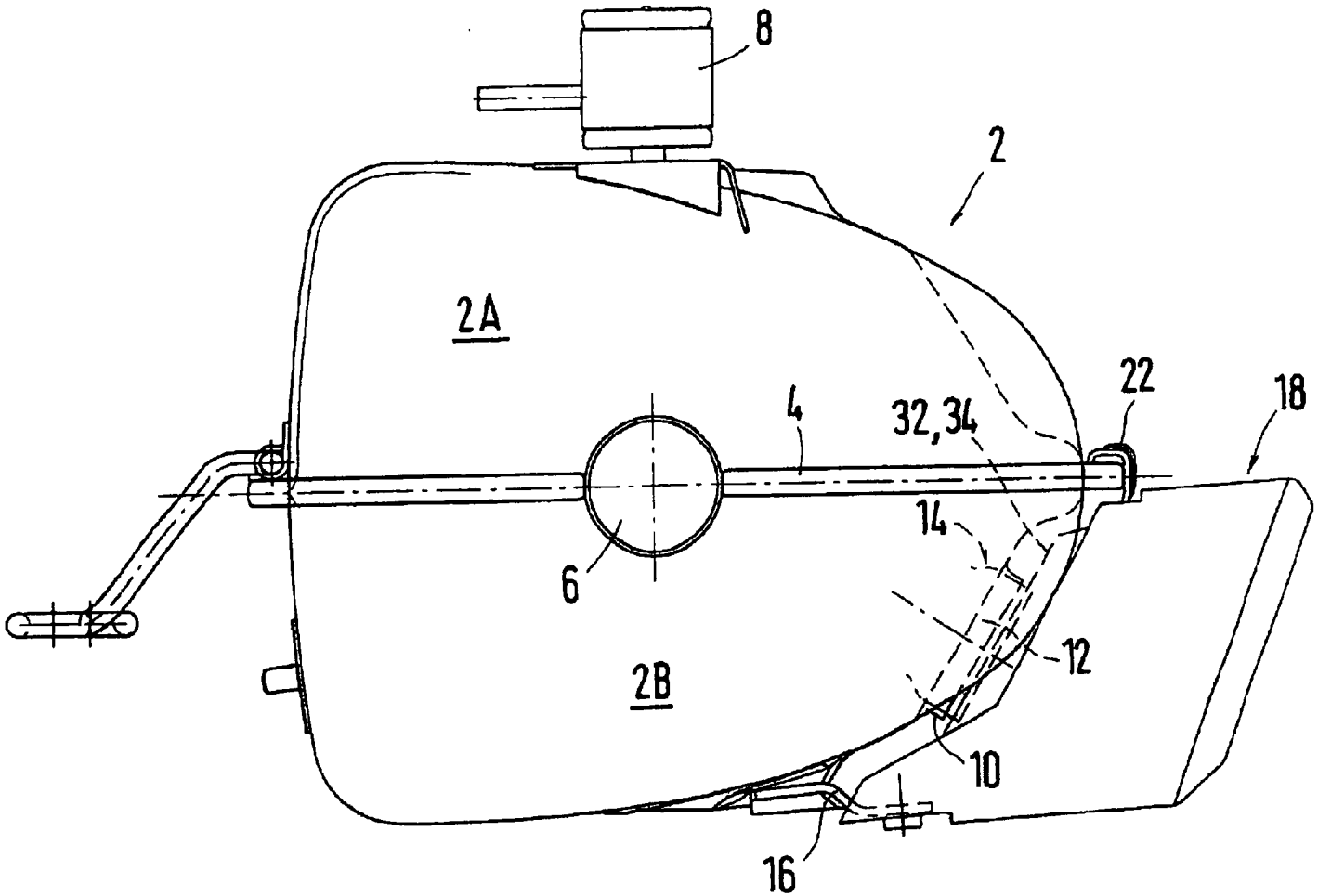
FIG. 5 is a lateral view of the end muffler with the mounted discharge pipe.

The end muffler housing 2 has two openings 12 which are provided with collars 10. The end of an exhaust pipe 14 arranged in the end muffler housing 2 is fitted in each opening and welded to one of the collars 10. Since the two collars 10 or openings 12 are situated behind one another, FIG. 5 shows only one collar 10 or one exhaust pipe 14 respectively. A lug 16 is fastened on the underside of the lower half shell 2B of the end muffler housing 2. The lug is provided with an opening and is used for fastening a mountable discharge pipe 18 which will be described in detail. The discharge pipe 18 has two mutually connected, double-walled individual pipes 18A and 18B. A fastening element 20 is provided between the two individual pipes 18A and 18B. The fastening element is formed from a sheet metal strip and is, for example, fastened by point welding to the two individual pipes 18A and 18B. With respect to the discharge pipe 18 mounted on the end muffler housing 2, the fastening element 20 forms a hook 22 at the top and a holding lug 26 provided with an opening 24 at the bottom. A nut 28 is soldered or welded onto the opening 24 of the holding lug 26.

The discharge pipe 18 is mounted to the end muffler housing 2 in the following manner:

By way of the hook 22, the discharge pipe 18 is suspended at the beaded collar edge 4 of the end muffler housing 2. The holding lug 26 provided on the discharge pipe 18 is fastened by way of the nut-bolt connection (28, 30) in a captive manner on the lug 16 provided on the end muffler housing 2. In the fastening condition, the exhaust pipes 14 arranged in the end muffler housing 2 engage in the two interior parts 32 and 34 of the discharge pipe 18, but without contacting them.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

We claim:

1. A mountable discharge pipe for an end muffler of a motor vehicle having devices for fastening the discharge pipe to an end muffler housing, comprising:

a hook provided on the discharge pipe, wherein the hook can be suspended at the end muffler housing, and a holding lug provided with an opening arranged on the discharge pipe so that the holding lug can be fastened by way of a nut-bolt connection on the end muffler housing, wherein the hook and the holding lug are formed from a sheet metal strip, and wherein the sheet metal strip is fastened between individual pipes of the discharge pipe.

2. The mountable discharge pipe according to claim 1, wherein the nut-bolt connection includes a nut, corresponding with the opening in the holding lug, which is welded or soldered onto the holding lug.

* * * * *